US008999229B2

(12) United States Patent
Cornelio et al.

(10) Patent No.: US 8,999,229 B2
(45) Date of Patent: Apr. 7, 2015

(54) COMPONENTS FOR EXHAUST SYSTEM, METHODS OF MANUFACTURE THEREOF AND ARTICLES COMPRISING THE SAME

(75) Inventors: Thomas J. Cornelio, Saint Marys, PA (US); Leonid I. Frayman, Dubois, PA (US); Thomas E. Haberberger, Saint Marys, PA (US)

(73) Assignee: Alpha Sintered Metals, Inc., Ridgway, PA (US)

( * ) Notice: Subject to any disclaimer, the term of this patent is extended or adjusted under 35 U.S.C. 154(b) by 817 days.

(21) Appl. No.: 13/294,841

(22) Filed: Nov. 11, 2011

(65) Prior Publication Data

US 2012/0128522 A1 May 24, 2012

Related U.S. Application Data

(60) Provisional application No. 61/414,759, filed on Nov. 17, 2010.

(51) Int. Cl.

| | |
|---|---|
| ***C22C 33/02*** | (2006.01) |
| ***B22F 3/16*** | (2006.01) |
| ***C22C 38/02*** | (2006.01) |
| ***C22C 38/22*** | (2006.01) |
| ***C22C 38/34*** | (2006.01) |
| ***B22F 3/10*** | (2006.01) |
| ***C22C 38/00*** | (2006.01) |

(52) U.S. Cl.

CPC ..... *C22C 33/0264* (2013.01); *B22F 3/1021* (2013.01); *C22C 38/002* (2013.01); *C22C 38/22* (2013.01); *C22C 38/34* (2013.01); *B22F 2998/00* (2013.01)

(58) Field of Classification Search

CPC . B22F 3/16; B22F 2009/041; C22C 33/0264; C22C 38/02; C22C 38/22; C22C 38/34

USPC ..... 419/25, 30, 32, 58; 75/228; 420/105, 420/117, 118, 123

See application file for complete search history.

(56) References Cited

U.S. PATENT DOCUMENTS

| | | | | |
|---|---|---|---|---|
| 3,950,575 | A | 4/1976 | Kitayama et al. | |
| 4,533,405 | A | 8/1985 | Sponseller et al. | |
| 5,326,526 | A * | 7/1994 | Ikenoue et al. | 419/32 |
| 5,476,632 | A | 12/1995 | Shivanath et al. | |
| 5,516,483 | A * | 5/1996 | Shivanath et al. | 419/25 |
| 5,656,787 | A * | 8/1997 | Shivanath et al. | 75/228 |
| 5,784,681 | A | 7/1998 | Purnell et al. | |
| 5,872,322 | A | 2/1999 | Mocarski et al. | |
| 5,993,507 | A | 11/1999 | Baum et al. | |
| 6,143,240 | A * | 11/2000 | Jones et al. | 419/25 |
| 6,280,683 | B1 * | 8/2001 | Hendrickson et al. | 419/32 |
| 6,485,678 | B1 * | 11/2002 | Liang et al. | 420/105 |
| 6,508,981 | B1 | 1/2003 | Perrin et al. | |
| 7,473,296 | B2 | 1/2009 | Takayama et al. | |
| 7,565,800 | B2 | 7/2009 | Williams et al. | |
| 8,479,700 | B2 * | 7/2013 | Qiao et al. | 123/188.3 |
| 2006/0277902 | A1 | 12/2006 | Williams et al. | |
| 2008/0274005 | A1 | 11/2008 | Liao et al. | |
| 2009/0142219 | A1 | 6/2009 | Hwang et al. | |
| 2009/0249774 | A1 | 10/2009 | Sloss et al. | |
| 2010/0146954 | A1 | 6/2010 | Sloss et al. | |
| 2011/0011070 | A1 | 1/2011 | Logan et al. | |

FOREIGN PATENT DOCUMENTS

| | | | |
|---|---|---|---|
| DE | 2318414 | * | 10/1974 |
| JP | 63/065054 | * | 3/1988 |
| JP | 06/256801 | * | 9/1994 |
| WO | 02095801 | A1 | 11/2002 |
| WO | 2006121826 | A2 | 11/2006 |
| WO | 2008015583 | A1 | 2/2008 |
| WO | 2008112720 | A1 | 9/2008 |
| WO | 2009108181 | A1 | 9/2009 |
| WO | 2011012983 | A1 | 2/2011 |

OTHER PUBLICATIONS

International Preliminary Report on Patentability for International Application No. PCT/US2011/060993, International Filing date Nov. 16, 2011; issued May 21, 2013 (4 pages).

International Search Report dated Jun. 11, 2012 for International Application No. PCT/US2011/060993.

Written Opinion of the International Searching Authority mailed Jun. 11, 2012 for International Application No. PCT/US2011/060993.

(Continued)

*Primary Examiner* — Helene Klemanski

(74) *Attorney, Agent, or Firm* — Cantor Colburn LLP

(57) ABSTRACT

Disclosed herein is a sintered composition comprising iron; about 0.05 to about 1 wt % molybdenum; about 3 to about 4.5 wt % silicon; about 0.05 to about 0.5 wt % chromium; about 0.011 to about 0.015 wt % magnesium; all weight percents being based on the total weight of the composition; the composition being devoid of carbon except for trace amounts; and wherein the composition is sintered. Disclosed herein too is a method comprising blending a powdered composition that comprises iron; about 0.05 to about 1 wt % molybdenum; about 3 to about 4.5 wt % silicon; about 0.05 to about 0.5 wt % chromium; about 0.011 to about 0.015 wt % magnesium; all weight percents being based on the total weight of the composition; the composition being devoid of carbon except for trace amounts; compacting and sintering the composition.

38 Claims, No Drawings

(56) References Cited

OTHER PUBLICATIONS

Black, Brent, et al, Microstructure and Dimensional Stability in Si—Mo Ductile Irons for Elevated Temperature Applications, Society of Automotive Engineers, Inc., 2002.

Perrin, D. Li, R et al., Solidification Behavior, Microstructure, Mechanical Properties, Hot Oxidation and Thermal Fatigue Resistance of High Silicon SiMo Nodular Cast Irons, SAE International, Advances in Lightweight Automotive Castings and Wrought Aluminum Alloys (SP-1838), 2004 SAE World Congress, Detroit, Michigan Mar. 8-11, 2004.

* cited by examiner

COMPONENTS FOR EXHAUST SYSTEM, METHODS OF MANUFACTURE THEREOF AND ARTICLES COMPRISING THE SAME

CROSS-REFERENCE TO RELATED APPLICATIONS

This disclosure claims priority to U.S. non-provisional application No. 61/414,759, filed on Nov. 17, 2010, the entire contents of which are incorporated herein by reference.

BACKGROUND

An engine assembly generally includes an exhaust system coupled to an engine to direct an exhaust gas flow therefrom. The exhaust system may include a system body fixed to a flange that couples the exhaust system to the engine. The system body may be welded to the flange generally at an end surface thereof that generally abuts the engine after assembly. The system body and flange are typically formed from similar materials to account for the thermal expansion experienced during the welding process.

Exhaust system components such as flanges, bosses, and the like, are commonly made from cast iron because cast iron often has advantages in terms of cost, durability, packaging and NVH (noise, vibration, and harshness). Cast iron for use in exhaust systems generally includes silicon-molybdenum cast iron. Cast silicon-molybdenum iron is generally manufactured with a certain amount of graphite or some other carbonaceous materials to improve mechanical properties like hardness, strength and anti-vibration (damping) capabilities as well as some technological properties such as machinability. Cast silicon-molybdenum iron when combined with carbon often becomes weaker as the temperature increases and is subject to damage from oxidation, decarburization, and coarsening at very high temperatures. The accumulation of damage and the elevated temperature strength (the thermal strength) of the material are important factors in evaluating the durability of the exhaust component. Moreover, the ability to weld parts of the exhaust systems together is hampered by the presence of carbon (especially in the form of graphite) in cast irons.

In particular, the accumulation of surface damage together with mechanical properties at elevated temperature and resistance to thermal cyclic loading are important factors in evaluating the durability of the materials to be used in the fabrication of exhaust components.

As automotive companies increase the operation temperatures in their engines to improve efficiency and to reduce exhaust emissions, more system applications are beginning to exceed the practical working (temperature) limit of cast irons. The temperature distribution in the exhaust system is not uniform and some peak temperature areas receive more heat than other areas resulting in the formation of severe thermal stresses. As a result, materials such as cast silicon-molybdenum iron are often inadequate for use in the exhaust system. Exhaust systems therefore have to be made from other more expensive materials. This results in an increase in the cost of the exhaust system.

Some other materials like those produced by Metal Injection Molding (MIM) are not a practical alternative for fabrication of exhaust systems because they substantially increase the cost of the components related to the use of specially prepared feedstocks with fine (generally 0.5 to less than 20 microns) predominantly spherical or rounded MIM-type powders that cause great shrinkage and are linked to huge amounts of distortion in the shape of sintered products.

In addition, it is desirable for MIM products to have about 30 to about 40% of organic (hydrocarbon-based) thermoplastic binder prior to the injection molding. The presence of a thermoplastic binder leads to the formation of carbon in the product, which as detailed above is detrimental to the performance of the product.

In addition, the ability of MIM-technology to produce large-size and thicker cross-sections is limited due to difficulties in controlling debinding of complex variable shapes as well as because of contamination from carbon additives to the product. Debinding refers to the removal of resinous binders used in the process of binding the metal prior to sintering it.

As noted above, the increase in the operating temperatures of automobile engines causes non-uniform temperature distributions in exhaust components leading to excessive stresses in the component. Currently, if a material such as cast silicon-molybdenum iron is inadequate for the peak temperature, the entire system has to be made from other more expensive materials. Therefore, the manufacturing costs for exhaust systems for high temperature applications are significantly increased.

SUMMARY

Disclosed herein is a sintered composition comprising iron; about 0.05 to about 1 wt % molybdenum; about 3 to about 4.5 wt % silicon; about 0.05 to about 0.5 wt % chromium; about 0.011 to about 0.015 wt % magnesium; all weight percents being based on the total weight of the composition; the composition being devoid of carbon except for trace amounts; and wherein the composition is sintered.

Disclosed herein too is a method comprising blending a powdered composition that comprises iron; about 0.05 to about 1 wt % molybdenum, about 3 to about 4.5 wt % silicon; about 0.05 to about 0.5 wt % chromium; about 0.011 to about 0.015 wt % magnesium; all weight percents being based on the total weight of the composition; the composition being devoid of carbon except for trace amounts; the powders all having a particle size less than (−70) mesh; press compacting the composition; and sintering the composition.

DETAILED DESCRIPTION

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Disclosed herein is a composition for manufacturing an exhaust system and its components such as flanges, bosses, and turbocharger components that comprise iron, silicon, and molybdenum. The composition can additionally optionally contain chromium and magnesium. The silicon is added independently to the composition in the form of a silicon powder or in the form of an iron-silicon masteralloy. The iron and molybdenum are also added either independently to the composition in the form of powder or in the form of an iron-molybdenum masteralloy. The composition is manufactured by blending a powdered composition that includes a combination of iron, silicon, molybdenum, chromium and magnesium, press compacting the powder to form a green "shape" or preform, and sintering the green "shape" or preform to form an article. The process does not involve casting or MIM-processing. In addition, the powdered composition does not include carbon or graphite, except for trace amounts of carbon that may be present.

This method of manufacturing the exhaust system and its components via a powder metal processing routine has certain advantages when compared with other conventional processes like casting or MIM-processing. For example, sintering the composition from a powder in comparison to casting process prevents certain defects such as pinholes and voids as well as the presence at casting operations of material liquation segregation associated with uneven distribution of alloying ingredients, and metal grain segregation during melting/cooling operations (e.g., dendrite structure formation). The main defects arising during MIM processing of exhaust components are associated with powder segregation during injection molding resulting in inconsistent or heterogeneous mechanical properties The iron is added in the form of a powder. In one embodiment, the iron powder has an average particle size of about 50 to about 210 micrometers. In an exemplary embodiment, the iron powder has an average particle size of about 70 to about 150 micrometers.

The molybdenum is also added to the composition either in the form of an elemental powder or as atomized alloyed iron-molybdenum powder (i.e., a masteralloy). In one embodiment, the molybdenum powder has an average particle size of about 40 to about 210 micrometers. In an exemplary embodiment, the atomized alloyed iron-molybdenum powder has an average particle size of about 55 to about 120 micrometers. In yet another embodiment, molybdenum may be added to the composition as elemental powder. The molybdenum is used in an amount of about 0.05 to about 1 wt %, specifically about 0.75 to about 0.95 wt %, based on the total weight of the composition.

The silicon is also added to the composition either in the form of a powder and/or as iron-silicon masteralloy. Alternatively, the silicon can be added as a ferro-silicon masteralloy containing about 30 to about 75 wt % of silicon, based on the total weight of the ferro-silicon masteralloy. In general, the silicon particulate additive has an average particle size of about 37 to about 210 micrometers. In an exemplary embodiment, the silicon added as a ferro-silicon masteralloy that has an average particle size of about 44 to about 150 micrometers. In another embodiment, silicon is added as a pure silicon powder with similar particle size range. An exemplary average particle size is about 105 micrometers. The silicon is used in an amount of about 3 to about 4.5 wt %, specifically about 3.1 to about 4.3 wt %, based on the total weight of the composition.

In one exemplary embodiment, the combination of molybdenum and silicon is used in an amount of about 3.75 to about 4.25 wt %, specifically about 3.95 to about 4.10 wt %, based on the total weight of the composition.

As noted above, chromium and magnesium may optionally be added to the composition. In one embodiment, only chromium may be added to the composition. In another embodiment, only magnesium may be added to the composition. In yet another embodiment, chromium and magnesium may be added to the composition.

The chromium is added to the composition in the form of either elemental powder or as an atomized alloyed iron-chromium masteralloy. The masteralloy is in the form of a powder.

All masteralloys are added in the form of powders. In one embodiment, the chromium powder has an average particle size of about 37 to about 210 micrometers. In an exemplary embodiment, the atomized alloyed iron-chromium masteralloy has an average particle size of about 55 to about 210 micrometers. In yet another embodiment, chromium may be added to the composition as elemental chromium powder. The chromium is used in an amount of about 0.05 to about 0.50 wt %, specifically about 0.15 to about 0.30 wt %, based on the total weight of the composition.

The magnesium is also added to the composition in the form of either elemental powder and/or as atomized alloyed iron-magnesium masteralloy. In one embodiment, the magnesium powder has an average particle size of about 2 to about 210 micrometers. In an exemplary embodiment, the magnesium powder has an average particle size of about 44 to about 150 micrometers. The magnesium is used in an amount of about 0.011 to about 0.015 wt %, specifically about 0.012 to about 0.0.014 wt %, based on the total weight of the composition.

The powders comprising iron, silicon, molybdenum and optionally chromium and magnesium are blended together. The blending of the powders may involve the use of admixing of atomized alloyed powders and elemental powders and particulate additives. The particulate adhesives can include a press lubricant in an amount of about 0.125% to about 1.0 wt %, based on the total weight of the adhesives. All powders including those of the additives have particle sizes less than (−70) mesh in order to ensure densification during the sintering process to achieve a final density of sintered parts of not less than 95% of theoretical density. The sintered components thus display functional properties like enhanced oxidation resistance and corrosion resistance at elevated temperatures as well as good welding ability and sufficient mechanical properties over other comparative compositions for similar applications that are manufactured by casting or MIM processing.

The blending of the powders may involve the use of agitation involving shear force, extensional force, compressive force, ultrasonic energy, electromagnetic energy, thermal energy or combinations comprising at least one of the foregoing forces or forms of energy and is conducted in processing equipment wherein the aforementioned forces or forms of energy are exerted by a single screw, multiple screws, intermeshing co-rotating or counter rotating screws, non-intermeshing co-rotating or counter rotating screws, reciprocating screws, screws with pins, screws with screens, barrels with pins, rolls, rams, helical rotors, balls, or a combination comprising at least one of the foregoing.

Blending may also be conducted in machines such as single or multiple screw extruders, ball mills, Buss kneaders, Henschel mixers, Waring blenders, helicones, Ross mixer, Banbury, roll mills, or the like, or a combination comprising at least one of the foregoing machines.

The blended powders of the composition are disposed in a mold and subjected to press compaction and subsequent sintering to form a sintered composition.

The press compaction can be conducted at either room or slightly elevated temperatures. In one embodiment, the pressure during press compaction at room temperature is raised to about 10 to about 70 tons per square inch, specifically about 35 to about 55 tons per square inch. In another embodiment, the press compaction is conducted at elevated temperatures of about 150 to about 170° F. The pressure and temperatures are used simultaneously or sequentially. Press compaction operation is performed to obtain a green density of about 80 to about 90% of theoretical density, specifically about 84 to about 88% of the theoretical density.

The sintering operation utilizes a pre-sintering stage that is used to facilitate de-lubrication for the complete removal of hydrocarbons from the powdered composition. In one embodiment, de-lubrication is performed in a separate thermal unit in an atmosphere comprising about 89% by volume of nitrogen and about 10% by volume of a hydrogen atmosphere and an oxidizing agent. Any carbon-containing atmosphere like methane, carbon monoxide, or carbon dioxide is avoided during pre-sintering. In general, pre-sintering is carried out at about 200° F. to about 2200° F., specifically at about 2095° F., and for a period of time from about 90 minutes to about 180 minutes.

The high-temperature segment of sintering operation is generally conducted in a reducing atmosphere containing not less than about 90% by volume of hydrogen gas, with the balance comprising an inert gas. Inert gases such as nitrogen, argon, and the like, may be used during the sintering process either as elemental additives or a gas mixture with hydrogen. In one embodiment, the sintering may be conducted in the presence of reducing gas comprising only hydrogen. No carbon-containing sintering atmospheres like methane, carbon monoxide or carbon dioxide or combinations thereof should be used.

The high-temperature segment of sintering is generally conducted at elevated temperature of about 2100° F. to about 2530° F. Temperatures below 2100° F. or above 2530° F. may be used if desired, but the pressure during sintering or the time utilized for the sintering may have to be changed. Alternatively, the composition may be varied in order to employ temperatures below 2100° F. or above 2530° F. However, sintering at temperatures less than about 2100° F. is generally not desirable because the ingredients (iron, silicon, molybdenum, magnesium or chromium) do not reach maximal rate of solid phase diffusion, hereby, leading to presence of brittle intermetallic phases as well as preventing the reduction of stable oxides like silicon oxide and chromium oxide. The sintering at temperatures of less than 2100° F. causes excessive residual porosity in the material while negatively affects weldability and formation of strong parts with adequate mechanical and thermal properties.

In addition, carrying out sintering at temperatures higher than 2530° F., generally results in extensive shape distortion of the parts, and also leads to partial effusion of liquid phase from sintered body onto its surface during sintering process, hereby negatively affecting component's shape change out of required tolerances as well as severe deterioration of mechanical and functional properties.

The sintering between about 2100° F. to about 2530° F. at low dew points with high hydrogen content in the sintering atmosphere facilitates a reduction of oxide films on the surface of powder particles and provides the appearance of a liquid phase within material composition that allows rapid densification of the powdered part to an almost poreless state resulting in enhanced combination of mechanical properties as well as superior hot oxidation resistance and corrosion resistance at elevated temperatures.

Sintering specifically from about 2300° F. to about 2450° F. provides the final density of sintered parts to be not less than 95% of theoretical density and produces optimal combination of hot oxidation resistance together with enhanced corrosion resistance and mechanical characteristics.

The sintering time at the high temperature segment of sintering (of about 2300° F. to about 2450° F.) is set for period from about 20 minutes to about 90 minutes and with the heat rate from about 175° F./minute up to about 215° F./minute to ensure reduction of oxide films on the surface of powder particles and to obtain enhanced oxidation resistance and satisfactory corrosion resistance at elevated temperatures. The referenced time period also provides sufficient conditions for sintering of exhaust component at low dew points with high hydrogen content in the sintering atmosphere to the level of sintered density not less than 95% of theoretical density for correspondingly high functional performance. In exemplary embodiment, the best oxidation, corrosion and mechanical characteristics are achieved at a temperature of about 2400° F. and a soaking time of about 55 minutes within a hydrogen sintering atmosphere. In an exemplary embodiment, the high-temperature segment of sintering is carried out at heat rate at 195° F./min.

Sintering process is ended by cooling of the parts in the furnace in a protective reducing (hydrogen together with nitrogen and argon gases or their mixture) atmosphere in the cooling end of the sintering furnace in order to ensure improved corrosion resistance of the sintered parts at elevated temperatures. The reducing atmosphere at cooling stage of sintering generally contains hydrogen, while the inert atmosphere comprises nitrogen or argon, but not containing any carboneous gases. In one embodiment, cooling segment of sintering is performed in an atmosphere that consists of hydrogen gas only, being after that completely burned-off at furnace outlet burn-off stack. The cooling segment of sintering is performed at the cooling rate from about 35° F./min to about 65° F./min in protective reducing atmosphere, containing either pure hydrogen gas, or hydrogen & nitrogen gas blend or hydrogen mixed together with nitrogen and argon gases mixture.

The sintered composition may be advantageously used for manufacturing articles like flanges or bosses or turborcharger components. The invention is further illustrated by the following non-limiting examples.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A sintered composition comprising:
iron;
about 0.05 to about 1 wt % molybdenum,
about 3 to about 4.5 wt % silicon;
about 0.05 to about 0.5 wt % chromium;
about 0.011 to about 0.015 wt % magnesium; all weight percents being based on the total weight of the composition; the composition being devoid of carbon except for trace amounts; and wherein the composition is sintered.

2. The sintered composition of claim 1, wherein the composition is compacted.

3. The sintered composition of claim 1, wherein the molybdenum is present in an amount of about 0.75 to about 0.95 wt %, based on the total weight of the composition.

4. The sintered composition of claim 1, wherein the molybdenum is added in the form of powder prior to compaction and sintering; the powder consisting of only molybdenum.

5. The sintered composition of claim 1, wherein the molybdenum is added in the form of an atomized masteralloy powder prior to compaction and sintering.

6. The sintered composition of claim 1, wherein the silicon is present in an amount of about 3.1 to about 4.0 wt %, based on the total weight of the composition.

7. The sintered composition of claim 1, wherein the silicon is added in the form of a powder prior to compaction and sintering; the powder consisting of only silicon.

8. The sintered composition of claim 1, wherein the silicon is not added in the form of a ferro-silicon masteralloy.

9. The sintered composition of claim 1, wherein the silicon has an average particle size of about 37 to about 210 micrometers.

10. The sintered composition of claim 1, wherein the silicon has an average particle size of about 44 to about 150 micrometers.

11. The sintered composition of claim 1, wherein the chromium is present in an amount of about 0.15 to about 0.3 wt %.

12. The sintered composition of claim 1, wherein the chromium is added in the form of powder prior to compaction and sintering; the powder consisting of only chromium.

13. The sintered composition of claim 1, wherein the chromium is added in the form of an atomized masteralloy powder prior to compaction and sintering.

14. The sintered composition of claim 1, wherein the magnesium is present in an amount of about 0.011 to about 0.015 wt %.

15. The sintered composition of claim 1, wherein the magnesium is added in the form of powder prior to compaction and sintering; the powder consisting of only magnesium.

16. The sintered composition of claim 1, where is magnesium is added as an atomized alloyed iron-magnesium masteralloy to the sintered composition.

17. A method comprising:
blending a powdered composition that comprises:
iron;
about 0.05 to about 1 wt % molybdenum,
about 3 to about 4.5 wt % silicon;
about 0.05 to about 0.5 wt % chromium;
about 0.011 to about 0.015 wt % magnesium; all weight percents being based on the total weight of the composition; the composition being devoid of carbon except for trace amounts; the powders all having a particle size less than (−70) mesh;
press compacting the composition; and
sintering the composition.

18. The method of claim 17, wherein the pressure employed during the press compacting is about 35 to about 55 tons per square inch and wherein the temperature during the press compacting is about 73° F. to about 170° F.

19. The method of claim 17, wherein the sintering comprises de-lubrication, high-temperature consolidation and cooling segments.

20. The method of claim 19, wherein the de-lubrication segment of sintering is carried out at a temperature of up to 2095° F. in an atmosphere comprising hydrogen, an oxidizing agent, and inert gases.

21. The method of claim 19, wherein the de-lubrication is carried out in a separate thermal device.

22. The method of claim 19, where the high-temperature consolidation segment of sintering is conducted at a temperature of about 2100° F. to about 2530° F.

23. The method of claim 19, where the high-temperature sintering consolidation segment of sintering is conducted at a temperature of about 2350° F. to about 2450° F. for a time period of about 20 to about 90 minutes.

24. The method of claim 19, where the high-temperature thermal consolidation segment of sintering is conducted at temperature of about 2400° F. for about 55 minutes.

25. The method of claim 19, wherein high-temperature thermal consolidation sintering segment of composition is performed in a reducing atmosphere that is devoid of carbonaceous gases.

26. The method of claim 19, wherein the high-temperature thermal consolidation segment of sintering is carried out in a mixture of reducing gases and inert gases at a heat rate about 175° F./minute to about 215° F./minute.

27. The method of claim 19, wherein the high-temperature thermal consolidation segment of sintering is carried out in a reducing gas atmosphere consisting of hydrogen.

28. The method of claim 19, wherein the cooling segment of sintering is conducted in a reducing atmosphere.

29. The method of claim 19, wherein the cooling segment of sintering is conducted in a mixture of a reducing atmosphere and an inert atmosphere.

30. The method of claim 19, wherein the cooling segment of sintering is conducted in a reducing atmosphere without any carbonaceous gas.

31. The method of claim 19, wherein the cooling segment of sintering is conducted in an atmosphere that consists of hydrogen gas.

32. The method of claim 19, wherein the cooling segment is conducted at a cooling rate of about 35° F./minute to about 65° F./minute.

33. An article manufactured from the sintered composition of claim 1.

34. The article of claim 33, wherein the article is an exhaust system component.

35. The article of claim 33, wherein the article is a flange for an exhaust system.

36. The article of claim 33, wherein article is a boss for an exhaust system.

37. The article of claim 33, wherein the article is a turbocharger component.

38. An article manufactured by the method of claim 17 and having a composition comprising:

iron;

about 0.05 to about 1 wt % molybdenum, about 3 to about 4.5 wt % silicon;

about 0.05 to about 0.5 wt % chromium;

about 0.011 to about 0.015 wt % magnesium; all weight percents being based on the total weight of the composition; the composition being devoid of carbon except for trace amounts.

* * * * *